US012018887B2

(12) United States Patent
Andrich et al.

(10) Patent No.: US 12,018,887 B2
(45) Date of Patent: Jun. 25, 2024

(54) HEAT EXCHANGER HAVING AN ARRANGEMENT OF MIXING DEVICES IMPROVING THE DISPENSING OF A BIPHASIC MATERIAL

(71) Applicant: L'Air Liquide Société Anonyme pour l'Etude et l'Exploitation des Procédés Georges Claude, Paris (FR)

(72) Inventors: Marine Andrich, Jouy-en-Josas (FR); Paul Berhaut, Saint Cyr l'Ecole (FR); Marc Wagner, Saint Maue des Fosses (FR)

(73) Assignee: L'Air Liquide, Societe Anonyme Pour l'Etude et l'Exploitation des Procedes, Georges Claude Paris (FR)

( * ) Notice: Subject to any disclaimer, the term of this patent is extended or adjusted under 35 U.S.C. 154(b) by 218 days.

(21) Appl. No.: 17/778,668

(22) PCT Filed: Nov. 16, 2020

(86) PCT No.: PCT/EP2020/082300
§ 371 (c)(1),
(2) Date: May 20, 2022

(87) PCT Pub. No.: WO2021/099275
PCT Pub. Date: May 27, 2021

(65) Prior Publication Data

US 2023/0003447 A1 Jan. 5, 2023

(30) Foreign Application Priority Data

Nov. 21, 2019 (FR) ..... 1913017

(51) Int. Cl.
*F25J 5/00* (2006.01)
*F25J 1/00* (2006.01)
(Continued)

(52) U.S. Cl.
CPC ..... *F25J 5/002* (2013.01); *F25J 1/0022* (2013.01); *F25J 1/0052* (2013.01); *F25J 1/0212* (2013.01);
(Continued)

(58) Field of Classification Search
CPC ..... F25J 5/002; F25J 1/0022; F25J 1/0052; F25J 1/0212; F25J 1/0214; F25J 1/0262; F25J 2290/32; F28F 3/048; F28D 9/0068
See application file for complete search history.

(56) References Cited

U.S. PATENT DOCUMENTS 4,646,822 A * 3/1987 Voggenreiter ..... F28D 9/0068 165/DIG. 387
5,943,881 A * 8/1999 Grenier ..... F25J 1/0215 62/913
7,163,051 B2 * 1/2007 Jibb ..... F28F 9/026 165/110
11,221,178 B2 * 1/2022 Haik-Beraud ..... F28D 9/0068
(Continued)

FOREIGN PATENT DOCUMENTS

FR 2 563 620 10/1985
FR 3 060 729 6/2018
(Continued)

OTHER PUBLICATIONS

International Search Report for corresponding PCT/EP2020/082300, dated Jan. 28, 2021.

*Primary Examiner* — Tho V Duong
(74) *Attorney, Agent, or Firm* — Elwood L. Haynes

(57) ABSTRACT

A heat exchanger having a first and second mixing devices having at least one lateral channel configured in order for a first phase of the first fluid to flow from at least one first inlet; a series of longitudinal channels extending in the longitudinal direction and each configured in order for a second phase of the first fluid to flow from a second inlet to a second
(Continued)

outlet, the longitudinal channels succeeding each other in a lateral direction orthogonal to the longitudinal direction; and at least one opening fluidly connecting the at least one lateral channel to at least one longitudinal channel such that the first and second mixing devices are configured to distribute a mixture of the first phase and the second phase via the second outlets of their respective longitudinal channels.

12 Claims, 5 Drawing Sheets

(51) Int. Cl.
*F25J 1/02* (2006.01)
*F28F 3/04* (2006.01)
*F28D 9/00* (2006.01)

(52) U.S. Cl.
CPC ..... *F25J 1/0214* (2013.01); *F25J 1/0262* (2013.01); *F25J 1/0292* (2013.01); *F28F 3/048* (2013.01); *F25J 2290/32* (2013.01); *F28D 9/0068* (2013.01)

(56) References Cited

U.S. PATENT DOCUMENTS

| | | | | |
|---|---|---|---|---|
| 11,754,337 | B2 * | 9/2023 | Noishiki | F25J 1/0025 62/48.2 |
| 2010/0181053 | A1 * | 7/2010 | Hecht | F25J 5/005 165/164 |
| 2018/0164051 | A1 * | 6/2018 | Noishiki | B01F 33/30 |
| 2018/0356150 | A1 | 12/2018 | Chambron | |
| 2019/0242651 | A1 * | 8/2019 | Granados | F25J 1/0022 |
| 2020/0109804 | A1 | 4/2020 | Grigoletto et al. | |
| 2020/0109894 | A1 * | 4/2020 | Grigoletto | F28F 27/02 |
| 2021/0010885 | A1 | 4/2021 | Haik-Beraud et al. | |

FOREIGN PATENT DOCUMENTS

| | | |
|---|---|---|
| WO | WO 2017 0081374 | 5/2017 |
| WO | WO 2018 002509 | 1/2018 |
| WO | WO 2018 109352 | 6/2018 |
| WO | WO 2018 172644 | 9/2018 |
| WO | WO 2018 172685 | 9/2018 |

* cited by examiner

HEAT EXCHANGER HAVING AN ARRANGEMENT OF MIXING DEVICES IMPROVING THE DISPENSING OF A BIPHASIC MATERIAL

CROSS REFERENCE TO RELATED APPLICATIONS

This application is a 371 of International Application No. PCT/EP2020/082300, filed Nov. 16, 2020, which claims priority to French Patent Application No. 1913017, filed Nov. 21, 2019, the entire contents of which are incorporated herein by reference.

BACKGROUND

The present invention relates to a heat exchanger comprising sets of passages for each of the fluids to be brought into a heat exchange relationship, the exchanger comprising an arrangement of mixing devices configured to more homogeneously distribute at least one mixture of two liquid-gaseous phases in at least one of the sets of passages.

In particular, the present invention can be applied to a heat exchanger that vaporizes at least one flow of a liquid-gas mixture, in particular a flow of a liquid-gas mixture with a plurality of constituent elements, for example, a mixture comprising hydrocarbons, by exchanging heat with at least one other fluid, for example, natural gas, that cools, or even at least partly liquefies, or even liquefied natural gas that sub-cools.

Among the methods using one or more fluid refrigeration cycle(s) with diphasic coolant, i.e. in the liquid/gas mixture state, several methods for liquefying a natural gas stream in order to obtain liquefied natural gas (LNG) are known. Typically, a cooling stream, generally a mixture with a plurality of constituent elements, such as a mixture containing hydrocarbons, is compressed by a compressor and then introduced into an exchanger or a series of exchangers where it is completely liquefied and sub-cooled to the coldest temperature of the method, typically that of the liquefied natural gas stream. At the coldest outlet of the exchanger, the cooling stream is expanded by forming a liquid phase and a gaseous phase. These two phases are separated by means of a phase separator and then reintroduced into the exchanger and remixed before being reintroduced into the exchanger in the liquid-gas mixture state, i.e. in the diphasic state. The cooling stream introduced into the exchanger in the diphasic state is vaporized therein against the hydrocarbon stream that liquefies and against the natural gas, Document WO-A-2017/081374 describes one of these known methods.

The use of brazed plate and fin aluminum exchangers allows very compact devices to be provided that provide a large exchange surface, thereby improving the energy performance capabilities of the method, and so doing in a limited volume.

These exchangers comprise a stack of plates that extend in two dimensions, length and width, thus forming a stack of a plurality of sets of passages positioned on top of each other, with some being intended for circulating a heat transfer fluid, for example, the hydrocarbon stream to be liquefied, and others being intended for circulating a coolant, for example, the diphasic cooling stream to be vaporized.

Heat exchange structures, such as heat exchange corrugations, are generally arranged in the passages of the exchanger. These structures comprise fins that extend between the plates of the exchanger and allow the heat exchange surface of the exchanger to be increased. They also function as spacers and contribute to the mechanical strength of the passages.

Some issues arise in exchangers implementing cooling streams of a diphasic nature, in particular when their vaporization occurs in an ascending vertical flow.

Indeed, in order to ensure that the exchanger operates correctly, i.e. in particular to maximize the use of its exchange surface, in particular for an exchanger implementing a liquid-gas mixture, the proportion of liquid phase and gaseous phase must be the same in all the passages and must be uniform within the same passage.

The dimensioning of the exchanger is computed assuming a uniform distribution of the phases, and thus a single temperature at the end of vaporization of the liquid phase per passage, equal to the dew point of the mixture.

For a mixture with a plurality of constituent elements in particular, the end of vaporization temperature will depend on the proportion of liquid phase and gaseous phase in the passages, since the two phases do not have the same compositions.

In the event of uneven distribution of the two phases, the temperature profile of the first fluid will therefore vary depending on the passages and/or within the same passage. Due to this non-uniform distribution, the one or more fluid(s) in an exchange relationship with the two-phase mixture can have an exchanger outlet temperature that is higher than the expected temperature, which consequently degrades the performance capabilities of the heat exchanger.

One solution for distributing the liquid and gaseous phases of the mixture as evenly as possible involves separately introducing them into the exchanger and then mixing them together only once they are inside the exchanger.

Documents FR-A-2563620 or WO-A-2018/172644 describe such exchangers, in which a grooved bar is inserted into the set of passages for channeling the two-phase mixture. This mixing device comprises a series of separate channels or grooves for the flow of the liquid phase of the coolant and another series of separate channels for the flow of the gaseous phase of the coolant. The channels of one series are fluidly connected to channels of the other series via openings so that a liquid-gas mixture is distributed out of the mixing device toward the heat exchange area. Each coolant passage of the exchanger is provided with such a device.

One problem that arises with this type of mixing device relates to the uneven distribution of the liquid-gas mixture in the width of the exchanger passages.

Indeed, the two-phase mixture is distributed at the outlet of the channels emerging into the passage. Since the channels are arranged at a certain distance from each other, the liquid-gas mixture is discretely introduced into the exchange zone over the width of the passage. As the fluid flows in the overall direction of flow in the exchanger, a distribution can occur in the direction orthogonal to the overall direction of flow, in particular by virtue of the exchange corrugations that are generally used in this type of exchanger, such as perforated or "serrated" corrugations that tend to deflect some of the fluid from its direction of flow.

However, homogenization of the fluid distribution over the width of the exchanger is only achieved after the mixture travels a certain distance after exiting the mixing device. Over this distance, the fluid supplies the exchange zone with uneven mass flow rates depending on the considered position in the width of the exchanger. Some channels of the exchange corrugations may have a limited or even no supply. The performance capabilities of the exchanger are degraded. In some configurations, acceptable homogenization may not even be achieved. This is particularly the case when the exchange zone is provided with straight corrugations, with which distribution by lateral deflection of the fluid is not possible.

Exchangers working subject to low temperature deviations between the heat transfer and coolant fluids are even more sensitive to this poor distribution phenomenon. In addition, the phenomenon of inhomogeneous distribution is accentuated in the case of a coolant mixture with a plurality of constituent elements.

None of the existing solutions is fully satisfactory. Thus, arranging a free space at the outlet of the mixing device raises problems in terms of the mechanical strength of the exchanger and can lead to the first phase accumulating in this zone. Increasing the number of channels succeeding each other in the width of the exchanger leads to a reduction in the flow rate in each channel and is detrimental to proper distribution of the mixture at the outlet. Finally; the "hardway" type of corrugation arrangement at the outlet of the mixing device or the arrangement of mixing devices with more complex geometry increases pressure losses, which degrades the performance capabilities of the method.

SUMMARY

The aim of the present invention is to address all or some of the aforementioned problems, in particular by proposing a mixing device providing more homogeneous distribution of a diphasic mixture in the width of the exchanger.

The solution according to the invention then involves a heat exchanger comprising a plurality of plates arranged parallel to each other and to a longitudinal direction, said plates being stacked in a spaced-apart manner so as to together define at least one first set of passages configured for a first fluid to generally flow in the longitudinal direction and at least one second set of passages configured for the flow of a second fluid to be brought into a heat exchange relationship with the first fluid, at least one first passage of the first set comprising a first mixing device and at least one second passage of the first set comprising a second mixing device, each of the first and second mixing devices comprising:

- at least one lateral channel configured in order for a first phase of the first fluid to flow from at least one first inlet;
- a series of longitudinal channels extending in the longitudinal direction and each configured in order for a second phase of the first fluid to flow from a second inlet to a second outlet, said longitudinal channels succeeding each other in a lateral direction orthogonal to the longitudinal direction; and
- at least one opening fluidly connecting said at least one lateral channel to at least one longitudinal channel such that the first and second mixing devices are configured to distribute a mixture of the first phase and the second phase via the second outlets of their respective longitudinal channels, characterized in that the longitudinal channels of the first mixing device are at least partly arranged at positions in the lateral direction that are different from the positions of the longitudinal channels of the second mixing device.

As applicable, the invention can comprise one or more of the following features:

- the second mixing device comprises two longitudinal edges extending parallel to the longitudinal direction, each longitudinal channel of the first mixing device being interposed, in the lateral direction between two successive longitudinal channels of the second mixing device or between a longitudinal channel and a longitudinal edge of the second mixing device;
- a single longitudinal channel of the first mixing device is interposed, in the lateral direction, between two successive longitudinal channels of the second mixing device or between a longitudinal channel and a longitudinal edge of the second mixing device;
- the longitudinal channels of the first mixing device are separated from each other by a first constant distance and the longitudinal channels of the second mixing device are separated from each other by a second constant distance, preferably the first distance and the second distance are equal;
- the series of longitudinal channels of the second mixing device is offset by an offset distance measured in the lateral direction, relative to the series of longitudinal channels of the first device, preferably the offset distance is between 25 and 75% of the first distance, preferably the offset distance is 50% of the first distance;
- the first distance and/or the second distance ranges between 10 and 40 mm, preferably it is greater than or equal to 20 mm and less than or equal to 30 mm;
- each of the first and second passages has a longitudinal axis of symmetry extending parallel to the longitudinal direction, with the longitudinal channels of each first and second mixing device being arranged symmetrically relative to the longitudinal axis of symmetry;
- the positions in the lateral direction of the longitudinal channels of the second mixing device coincide, following a 180° rotation in the plane defined by the lateral direction and by the longitudinal direction, with the positions in the lateral direction of the longitudinal channels of the first device;
- it comprises a plurality of alternately arranged first passages and second passages, with at least one passage of the second set being arranged between at least one first passage and at least one second passage following said at least one first passage;
- the lateral channels and/or the longitudinal channels of the first mixing device and the second mixing device are straight, preferably of parallelepiped or generally parallelepiped shape;
- the first and second mixing devices each comprise a series of lateral channels extending in the lateral direction and succeeding each other in the longitudinal direction.

According to another aspect, the invention relates to a method for liquefying a stream comprising hydrocarbons such as natural gas as a second fluid, said method implementing at least one exchanger according to the invention and comprising the following steps:

a) introducing the hydrocarbon stream into the passages of the second set;
b) introducing a cooling stream into a third set of passages of the heat exchanger;
c) discharging the cooling stream from the heat exchanger and expanding the cooling stream to at least one pressure level so as to produce at least one diphasic cooling stream;
d) separating at least part of the diphasic cooling stream originating from step c) into a gaseous phase and a liquid phase;
e) introducing at least part of the gaseous phase and at least part of the liquid phase into each of the first and second passages of the first set, respectively, via separate inlets of said first and second passages;

f) passing the phases introduced in step e) into first and second mixing devices so as to obtain a first fluid formed by a mixture of the first phase (61) and the second phase at the outlet of each of the first and second mixing devices;

g) vaporizing at least part of the first fluid originating from step f) in the first and second passages by exchanging heat with at least the hydrocarbon stream so as to obtain a cooled and/or at least partially liquefied hydrocarbon stream at the outlet of the exchanger.

The expression "natural gas" refers to any composition containing hydrocarbons, including methane at least. This comprises a "raw" composition (prior to any treatment or scrubbing) and also any composition that has been partially, substantially or totally treated for reducing and/or eliminating one or more compounds; including, but without being limited to, sulfur, carbon dioxide, water, mercury and certain heavy and aromatic hydrocarbons.

BRIEF DESCRIPTION OF THE DRAWINGS

The present invention will now be better understood by virtue of the following description, which is provided solely by way of a non-limiting example and with reference to the accompanying figures, among which.

DETAILED DESCRIPTION OF PREFERRED EMBODIMENTS

Figure 1:
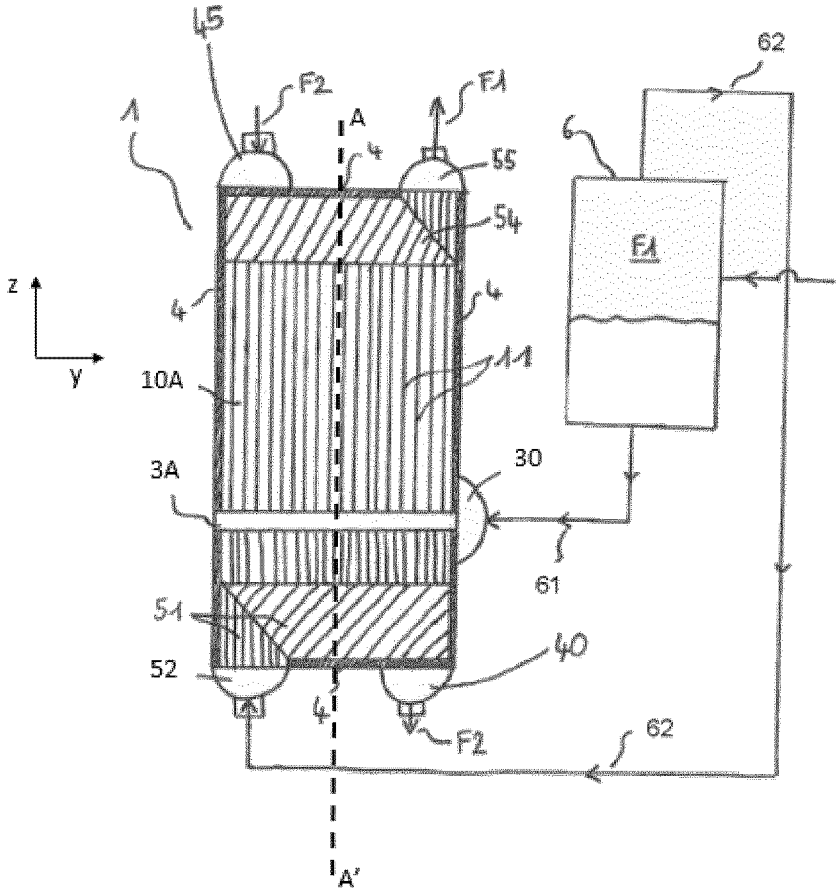
FIG. 1 schematically shows a heat exchanger according to one embodiment of the invention.

FIG. 1 is a section view of a heat exchanger comprising a stack of plates 2 (not shown) that extend in two dimensions, parallel to a plane defined by a longitudinal direction z and a lateral direction y. The plates 2 are arranged parallel, one above the other, with a spacing between and thus form a stack of passages for fluids in an indirect heat exchange relationship via said plates.

Preferably, each passage has a parallelepiped and flat shape. The gap between two successive plates is small compared to the length; measured in the longitudinal direction z, and the width, measured in the lateral direction y, of each passage.

The exchanger 1 can comprise more than 20 plates, or even more than 100, together defining a first set of first and second passages 10A, 10B (the passages 10B are not shown in FIG. 1) for channeling at least one first fluid F1, and a second set of passages 20 (not shown in FIG. 1) for channeling at least one second fluid F2, with the flow of said fluids generally occurring in the direction z. The passages 10A, 10B can be arranged, in whole or in part, alternately and/or adjacent to all or some of the passages 20. The exchanger 1 can comprise a third set of passages, or even more, for the flow of one or more additional fluid(s). These sets of passages are stacked relative to each other forming a stack of passages.

The seal for the passages 10A, 10B, 20 along the edges of the plates 2 is generally provided by lateral and longitudinal sealing strips 4 attached to the plates 2. The lateral sealing strips 4 do not completely seal the passages 10A, 10B, 20 but advantageously leave fluid inlet and outlet openings located in the diagonally opposite corners of the passages.

The openings of the passages 10A, 10B of the first set are arranged so as to coincide one above the other, while the openings of the passages 20 of the second set are arranged in the opposite corners. The openings placed one above the other are respectively joined in semi-tubular manifolds 40, 45, 52, 55, through which the fluids are distributed and discharged into and from the passages 10A, 10B, 20.

It should be noted that configurations for introducing and discharging fluids other than that shown in FIG. 1 can be used. The openings of the passages thus can be arranged at other positions in the width of the exchanger, in particular at the center of the width of the exchanger, and/or at other positions in the length of the exchanger. In the illustration of FIG. 1, the semi-tubular manifolds 52 and 45 are used to introduce fluids into the exchanger 1 and the semi-tubular manifolds 40, 55 are used to discharge these fluids out of the exchanger 1.

In this alternative embodiment, the manifold supplying one of the fluids and the manifold discharging the other fluid are located at the same end of the exchanger, with the fluids F1, F2 thus flowing counter-currently through the exchanger 1.

According to another alternative embodiment, the first and second fluids can also circulate co-currently, with the means for supplying one of the fluids and the means for discharging the other fluid then being located at opposite ends of the exchanger 1.

Preferably, the direction z is oriented vertically when the exchanger 1 is operating. The first fluid F1 generally flows vertically and upwardly. Other flow directions and courses of the fluids F1, F2 obviously can be contemplated, without departing from the scope of the present invention.

It should be noted that, within the scope of the invention, one or more second fluid(s) F2 with different natures can flow within the passages 20 of the second set.

Preferably, the first fluid F1 is a coolant and the second fluid F2 is a heat transfer fluid.

The exchanger advantageously comprises distribution corrugations 51, 54, arranged between two successive plates 2 in the form of corrugated sheets, which extend from the inlet and outlet openings. The distribution corrugations 51, 54 ensure the uniform distribution and recovery of the fluids over the entire width of the passages 10A, 10B, 20.

Furthermore, the passages 10A, 10B, 20 advantageously comprise heat exchange structures arranged between the plates 2. The purpose of these structures is to increase the heat exchange surface of the exchanger and to increase the exchange coefficients between the fluids by making the flows more turbulent. Indeed, the heat exchange structures are in contact with the fluids circulating in the passages and transfer thermal flows by conduction up to the adjacent plates 2, to which they can be attached by brazing, which increases the mechanical strength of the exchanger.

The heat exchange structures also act as spacers between the plates 2, in particular when assembling the exchanger by brazing and to avoid any deformation of the plates when implementing pressurized fluids. They also ensure that the fluid flows are guided in the passages of the exchanger.

Preferably, these structures comprise heat exchange corrugations 11, which advantageously extend over the width and the length of the passages 10A, 10B, 20, parallel to the plates 2, in the extension of the distribution corrugations along the length of the passages. The passages 10A, 10B, 20 of the exchanger thus have a main part of their length forming the heat exchange part itself, which is lined with a heat exchange structure, with said main part being bordered by distribution parts lined with the distribution corrugations 51, 54.

FIG. 1 shows a first passage 10A of the first set configured for the flow of a first fluid F1 in the form of a two-phase mixture, also called a diphasic mixture. The first set comprises a plurality of first passages 10A of this type, as well as a plurality of second passages 10B stacked on the first passages and having a similar structure to that of the first passages 10A. The first fluid F1 is separated, in a separator device 6, into a first phase 61 and a second phase 62 separately introduced into the exchanger 1 by means of a separate first manifold 30 and second manifold 52. Preferably, the first phase 61 is liquid and the second phase 62 is gaseous.

The first and second phases 61, 62 are then mixed together by means of a first mixing device 3A arranged in at least one first passage 10A. Advantageously, several first passages 10A, or even all the passages 10A, of the first set comprise a first mixing device 3A. Similarly, the first and second phases 61, 62 are mixed together by means of a second mixing device 3B arranged in at least one second passage 10B. Advantageously, several second passages 10B, or even all the passages 10B of the first set, comprise a second mixing device 3B. The semi-tubular manifolds 52 and 55 are fluidly connected to the inlets and outlets of the passages 10A and 10B. The first manifold 30 is fluidly connected to at least one first inlet 311A, 311B of each of the first and second mixing devices 3A, 3B. The second manifold 52 is fluidly connected to at least one second inlet 321A, 321B of each of the first and second mixing devices 3A, 3B.

It should be noted that FIG. 1 shows a mixing device 3A positioned at a certain distance from the distribution zone 51 of the exchanger 1. According to an alternative embodiment, the first mixing device 3A can be positioned directly after the distribution zone, or juxtaposed with said zone, that is by being a single piece with the distribution zone. According to this latter possibility, the mixing device forms a one-piece part, which can be manufactured by conventional machining or by additive manufacturing, i.e. by 3D printing, for example, by laser sintering.

Figure 2:
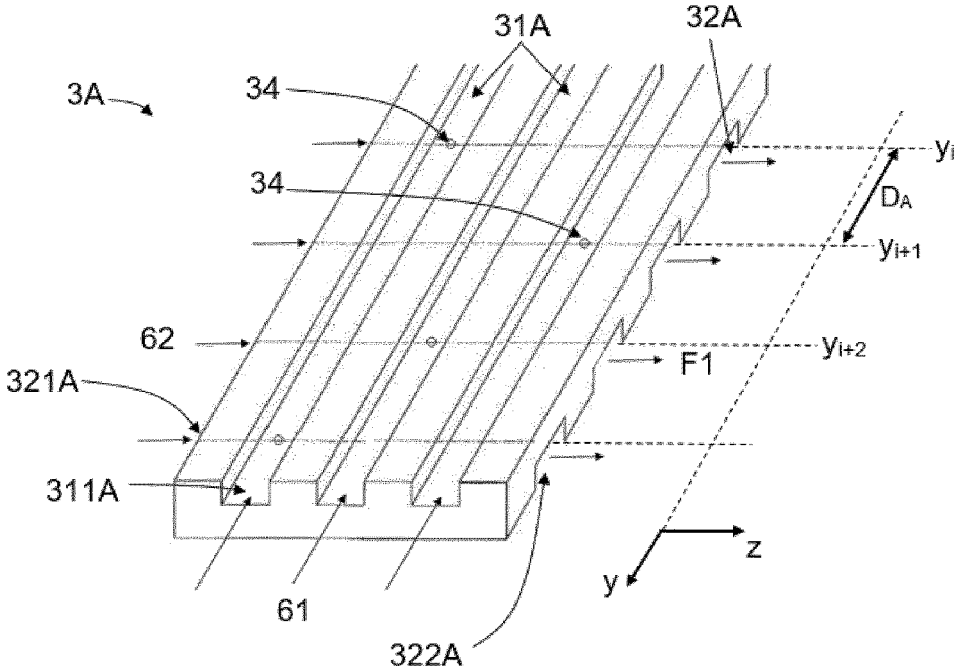
FIG. 2 is a three-dimensional schematic view of a first mixing device according to one embodiment of the invention.

FIG. 2 is a three-dimensional view of a first mixing device 3A advantageously made up of a bar, or rod, housed in a first passage 10A. The second mixing device 3B can have all or some of the features described for the first device 3A.

The first mixing device 3A preferably extends into the section of the passage 10 over almost all, or even all, the height of the first passage 10A, so that the mixing device is in contact with each plate 2 forming the first passage 10A.

The first mixing device 3A is advantageously attached to the plates 2 by brazing.

The first mixing device 3A advantageously has an overall parallelepiped shape.

Preferably, the first mixing device 3A is a one-piece part, i.e. formed by a block or as a single piece. The first mixing device 3A can be manufactured by conventional machining or by additive manufacturing. The first mixing device 3A can have, parallel to the longitudinal direction z, a first dimension ranging between 20 and 200 mm and, parallel to the lateral direction y, a second dimension ranging between 100 and 1,400 mm.

The first mixing device 3A comprises at least one lateral channel 31A configured for the first phase 61 of the first fluid F1 to flow from at least one first inlet 311A, Preferably, the lateral channel 31A extends parallel to the lateral direction y.

It further comprises a series of longitudinal channels 32A extending parallel to the longitudinal direction z and configured for the second phase 62 of the first fluid F1 to flow from a second inlet 321A up to a second outlet 322A, with said longitudinal channels 32 being arranged at successive positions $y_i$, $y_{i+1}$, . . . in the lateral direction y.

Preferably, the lateral channel 31A extends over the entire second dimension and/or the longitudinal channel 32A extends over the entire first dimension.

Preferably, the mixing device 3A comprises at least one first inlet 311A in fluid communication with the first manifold 30 and a second inlet 321A, separate, i.e. distinct, from the first inlet 311, in fluid communication with the second manifold 52. The first manifold 30 is fluidly connected to a first phase source 61 and the second manifold 52 is fluidly connected to another second phase source 62. Said at least one first inlet 311A and said at least one second inlet 321A are brought into fluid communication via at least one opening 34. The first and second inlets are advantageously formed by causing the lateral and longitudinal channels to emerge at the lateral and longitudinal peripheral edges of the devices 3A, 3B.

FIG. 2 shows the introduction of the first phase 61 via an end of the device 3A comprising a plurality of first inlets 311A. According to an advantageous embodiment, the first mixing device 3A comprises at least one other first inlet for the first phase 61 located at an opposite end of the device 3A. Advantageously, these other inlets are obtained by extending the lateral channels 31A, 31B until they emerge at an opposite lateral edge of the exchanger 1. In this case, another first manifold 30 is arranged on an opposite side of the exchanger 1. Introducing the first phase 61 on either side of the mixing device allows the effect of the pressure losses to be reduced when the first phase flows in the lateral channels, which promotes more homogeneous distribution of the diphasic mixture over the width of the exchanger.

Preferably, the first mixing device 3A comprises a mixing volume located in the longitudinal channel 32A, downstream of the opening 34 in the direction of flow of the first phase 61 in the opening 34.

The lateral channel 31A is fluidly connected to at least one longitudinal channel 32A such that, when the first phase 61 flows in the lateral channel 31A and the second phase 62 flows in the longitudinal channel 32A, the first mixing device 3A distributes, via a second outlet 322A of the channel 32A, a mixture of the first phase 61 and the second phase 62, preferably a two-phase liquid/gas mixture F1. Preferably, the longitudinal channel and/or the lateral channel are generally straight.

The channels 31A, 32A are advantageously in the form of longitudinal recesses provided in the mixing device 3. They preferably emerge at the upper 3*a* and lower 3*b* surfaces of the mixing device 3A.

Preferably, the channels 31A, 32A have a square or rectangular transverse section, but optionally can assume other shapes (round, round portion, etc.).

The openings 34 advantageously are perforations 34 made in the material of the device 3A and extending between the lateral channel 31A and the longitudinal channel 32A, preferably in the plane formed by the directions x and y, with the openings 34 being able to be inclined with respect to the direction x or, preferably, to be aligned with the vertical direction x. Preferably, the openings 34 have cylindrical symmetry, and more preferably are cylindrical.

Preferably, said at least one lateral channel 31A comprises a bottom wall 3*c* and said at least one longitudinal channel 32A comprises a top wall 3*d*, which extends opposite the bottom wall 3*c*, with the openings 34 being perforated in the bottom wall of the lateral channel 31 and emerging into the top wall of the longitudinal channel 32A.

Figure 3:
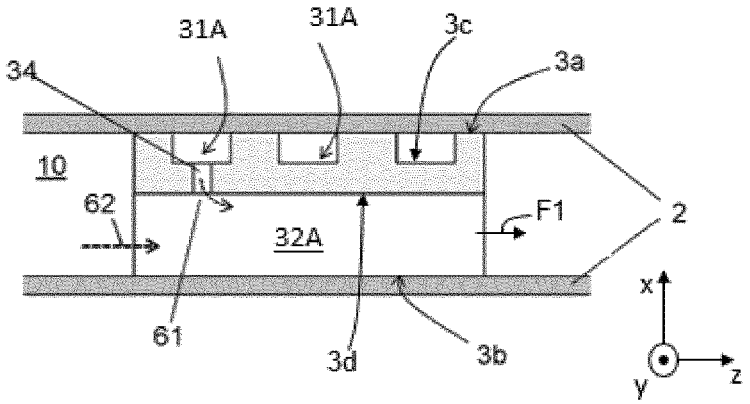
FIG. 3 is a schematic section view, in a plane perpendicular to the plates of the exchanger, of a first mixing device according to one embodiment of the invention.

FIG. 3 is a view of the mixing device 3A of FIG. 2 in a section plane orthogonal to the lateral direction y and passing through the opening 34.

For the sake of convenience, mixing devices with the same geometry are normally arranged in the passages 10A, 10B of the first set, in particular longitudinal channels arranged at the same positions in the lateral direction y.

At the outlet of each longitudinal channel, the flow of the two-phase mixture of the first fluid F1 preferably occurs in the longitudinal direction z, with a gradual expansion of the flow in the width of the passage. The homogenization of the flows in each passage is only obtained beyond a certain distance covered by the mixture. This lack of homogenization of the mixture F1 occurs throughout the stack of passages 10A, 10B of the first set.

In order to address these problems, the present invention proposes arranging a first mixing device 3A and a second mixing device 3B in a first passage 10A and in a second passage 10B, respectively, of the first set, with said mixing devices having a different configuration with at least part, preferably all, of the longitudinal channels 32A of the first mixing device 3A being positioned, in the lateral direction y, at different positions to those of the longitudinal channels 32B of the first mixing device 3A. It should be noted that the term at least some is understood to mean one or more or all the longitudinal channel(s) 32A of the series.

This allows the two-phase mixture of the fluid F1 to be distributed at points that are distributed differently over the width of the exchanger. Thus, by considering the assembly formed by the first passage 10A and the second passage 10B, the homogenization of the diphasic mixture experienced by the second fluid is generally improved. Indeed, by considering the outlets of the longitudinal channels 32A and the outlets of the longitudinal channels 32B to be arranged in the same plane, the distances that separate one channel from the next, measured in the lateral direction y, can be reduced. While in the prior art, i.e. two mixing devices with identical channel positions, the distances separating one channel from the next are necessarily equal to the inter-channel distance of each device. It should be noted that, with the invention, it is possible to achieve better homogenization, without the flow of fluid in each longitudinal channel being affected or significantly affected.

By virtue of the invention, the disparities in the mixing rate in the width of the exchanger are reduced, or even eliminated, after a shorter propagation distance of the mixture downstream of the mixing devices. The heat exchanges between the diphasic mixture and the second fluid F2, and thus the operation of the exchanger, are improved.

Furthermore, the mechanical strength of the exchanger, during the brazing or the operation thereof, is improved. Indeed, the channels 32A and 32B are no longer positioned in a superposed manner in the stack of the exchanger and the resulting lack of material in the channels 32A and 32B is better distributed, which stiffens the stack. Furthermore, the thermal stresses are reduced due to better distribution of the diphasic mixture that is experienced by the second fluid.

Preferably, the first set of passages for the flow of the two-phase mixture comprises a plurality of first passages 10A and a plurality of second passages 10B comprising first and second mixing devices configured according to the invention. The first passages 10A and the second passages 10B are advantageously alternately positioned within the stack of passages forming the exchanger.

Preferably, at least one passage 20 of the second set is arranged between at least one first passage 10A and at least one second passage 10B following said at least one first passage 10A. In particular, the stack of passages can have the following alternating pattern: first passage 10A, passage 20, second passage 10B, passage 20, first passage 10A, passage 20, etc. Thus, the number of coolant passages is minimized. According to another possibility, the stack of passages can have the following alternating pattern: first passage 10A, second passage 10B, passage 20, first passage 10A, second passage 10B, passage 20, etc.

The present invention enables better homogenization of the overall refrigerating supply of the diphasic mixture to the second heat transfer fluid and therefore improves the performance capabilities of the exchanger.

Figure 4:
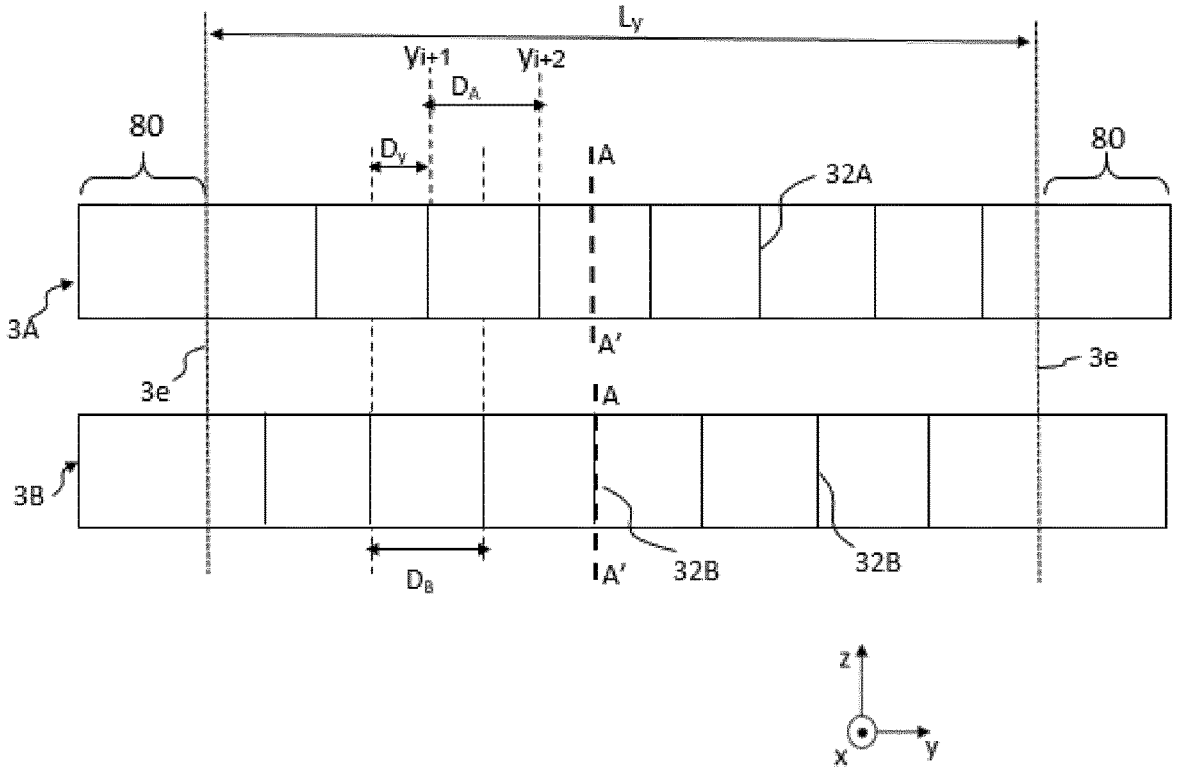
FIG. 4 is a schematic section view, in a plane parallel to the plates of the exchanger, of a first and a second mixing device according to one embodiment of the invention.
Figure 5:
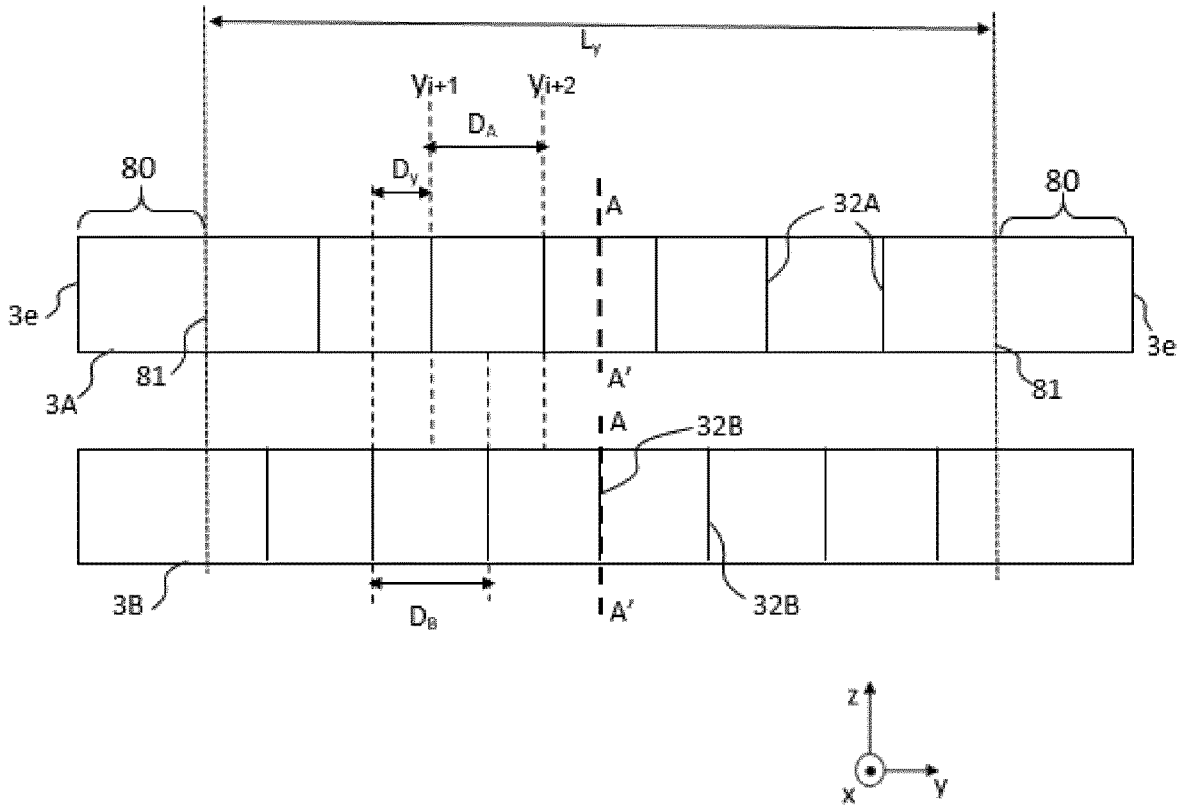
FIG. 5 is a schematic section view, in a plane parallel to the plates of the exchanger, of a first and a second mixing device according to another embodiment of the invention.

FIG. 4 and FIG. 5 show embodiments of first and second devices 3A, 3B according to the invention. It should be noted that the devices 3A, 3B are shown side-by-side in the same plane but, during operation, they are arranged in separate passages 10A, 10B superposed in the direction x, they are preferably located at the same position in the longitudinal direction z. The positioning of the longitudinal channels 32A, 32B within the devices 3A, 3B is schematically shown by vertical lines. The axis AA represents the longitudinal axis of symmetry of each passage 10A, 10B in the plane formed by the directions y and z.

FIG. 4 and FIG. 5 schematically show the longitudinal channels in the form of lines. It should be noted that the positions $y_i$, $y_{i+1}$, $y_{i+2}$ . . . of each channel in the lateral direction y can be determined by considering the position of the center of each channel in the lateral direction y. For example, by considering channels in the form of parallelepiped or generally parallelepiped grooves, as shown in FIG. 2, the position of a channel in the direction y corresponds to the position of the axis of symmetry of the channel located at an equal distance from the lateral walls of the channel, as shown in FIG. 2.

Preferably, the longitudinal channels 32A of the first mixing device 3A are separated from each other by a first constant distance $D_A$ and the longitudinal channels 32B of the second mixing device 3B are separated from each other by a second constant distance $D_B$. The distances $D_A$, $D_B$ are measured parallel to the longitudinal direction y.

Preferably, the first distance $D_A$ and the second distance $D_B$ are equal.

The first distance $D_A$ and/or the second distance $D_B$ can range between 10 and 40 mm, preferably it is greater than or equal to 20 mm and less than or equal to 30 mm.

Preferably, the mixing devices 3A, 3B are each defined by two longitudinal edges 3*e*.

Preferably, the mixing devices 3A, 3B are dimensioned so as to at least partially cover, preferably entirely cover, the longitudinal sealing strips 4 that seal the passages in the longitudinal direction z.

The mixing devices 3A, 3B thus have a useful width $L_y$ that is less than the distance between the two longitudinal edges 3*e* and that corresponds to the width of the mixing devices that is exposed to the fluid, i.e. the width of the passage 10A or 10B, The mixing devices 3A, 3B have a useful width zone $L_y$ that extends between two ends 81 and overlapping zones 80, which extend beyond the passages 10A, 10B and the width of which advantageously corresponds to that of the lateral sealing strips 4, as shown in FIG. 1. Such an arrangement ensures the rigidity of the stack and better mechanical strength of the brazed assembly.

Preferably, each longitudinal channel 32A of the first mixing device 3A is interposed, in the lateral direction y, between two successive longitudinal channels 32B of the second mixing device 3B or between a longitudinal channel 32B and a longitudinal edge 3*e* of the second mixing device 3B.

Preferably, a single longitudinal channel 32A of the first mixing device 3A is interposed, in the lateral direction y, between two successive longitudinal channels 32B of the second mixing device 3B or between a longitudinal channel 32B and a lateral edge 3*e* of the second mixing device 3B.

Preferably, each pair of successive longitudinal channels 32B of the second mixing device 3B corresponds to a longitudinal channel 32A of the first mixing device 3A interposed between the channels of said pair, optionally with a longitudinal channel 32A of the first mixing device 3A interposed between a longitudinal channel 32B and a lateral edge 3*e* of the second mixing device 38.

Preferably, the series of longitudinal channels 32B of the second mixing device 3B is offset by a predetermined offset distance $D_y$, measured in the lateral direction y, relative to the series of longitudinal channels 32A of the first device 3A.

Preferably, the offset distance $D_y$ is between 25 and 75% of the first distance $D_A$, preferably the offset distance $D_y$ is of the order of 50% of the first distance $D_A$. The expression "of the order" means 50% or approximately 50%, with a variation of more or less than 10% around this value.

In the configuration according to FIG. 4, the first and second mixing devices have an identical structure, with one of the mixing devices being rotated by 180° relative to the other in the plane formed by the directions y and z before being mounted in its passage. The advantage of this configuration is that only one type of mixing device needs to be manufactured, with the different distribution of the longitudinal channels 32A, 32B being obtained by simply turning the device in the plane formed by the directions y and z. Advantageously, the distances $D_A$ and $D_B$ are equal and the offset $D_y$ is equal to half of $D_A$. The number of longitudinal channels 32A, 32B of the first and second mixing devices is identical. The longitudinal channels 32A, 32B are arranged such that, for one of the mixing devices, the first longitudinal channel of the series is located at a distance $D_A$ from one end 81 of the useful zone and the last longitudinal channel 32A of the series is located at a distance $D_A/2$ from the opposite end 81 of the useful zone, and vice versa for the other mixing device.

FIG. 5 shows an alternative embodiment in which the longitudinal channels of the first and second passages 10A, 10B are arranged symmetrically relative to the axis of symmetry AA of the exchanger. The advantage of this configuration is that distribution points of the diphasic mixture are kept symmetrically distributed in the width of the exchanger. Advantageously, the distances $D_A$ and $D_B$ are equal and the offset $D_y$ is equal to half of $D_A$. One of the first and second mixing devices has an additional longitudinal channel relative to the other mixing device. The longitudinal channels 32A, 32B are arranged such that, for one of the mixing devices, the first longitudinal channel and the last longitudinal channel 32A of the series are located at a distance $D_A$ from each opposite end 81 of the useful zone. For the other mixing device, the first longitudinal channel and the last longitudinal channel of the series are located at a distance $D_A/2$ from the opposite ends 81 of the useful zone. The useful width $L_y$ of the mixing devices is a multiple of the distance $D_A$.

According to a preferred embodiment, the first and second mixing devices 3A, 3B are arranged in their respective passages 10A, 10B so that their lower surfaces 3*b*, at which their longitudinal channels 32A, 32B emerge, are all oriented in the vertical direction x or, as illustrated in particular in FIG. 3, are all oriented in a direction opposite the vertical direction x.

According to an alternative embodiment, at least one of the first mixing devices 3A has a lower surface 3*b* oriented in an opposite direction relative to the direction of orientation of the lower surface 3*b* of at least one second mixing device 3B and/or of at least one other first mixing device 3A, i.e. at least one first mixing device is turned around, before being arranged in its passage, by 180° about an axis parallel to the direction y. This allows the flow of the two-phase mixture to be oriented toward certain adjacent passages 20 of the second set in order to promote a heat exchange with certain heat transfer fluids instead of others. For example, an alternating orientation of the lower surfaces 3*b* of the first and second mixing devices succeeding each other in the stack of passages can be contemplated.

The above description is provided by considering two configurations of mixing devices, with it being understood that three or more configurations can be implemented and that it involves one or more of the features being applicable. In particular, the longitudinal channels of the additional mixing devices are arranged, in the lateral direction y, at positions that are different from those of the first and second mixing devices. In particular, in the case of three different mixing devices, the exchanger would comprise a third mixing device 3C with longitudinal channels 32C, with the longitudinal channels of the first mixing device 3A and of the second mixing device 3B being interposed, in the lateral direction y, between two successive longitudinal channels 32C of the third device or between a longitudinal channel 32C and a longitudinal edge of the third device 3C.

Figure 6:
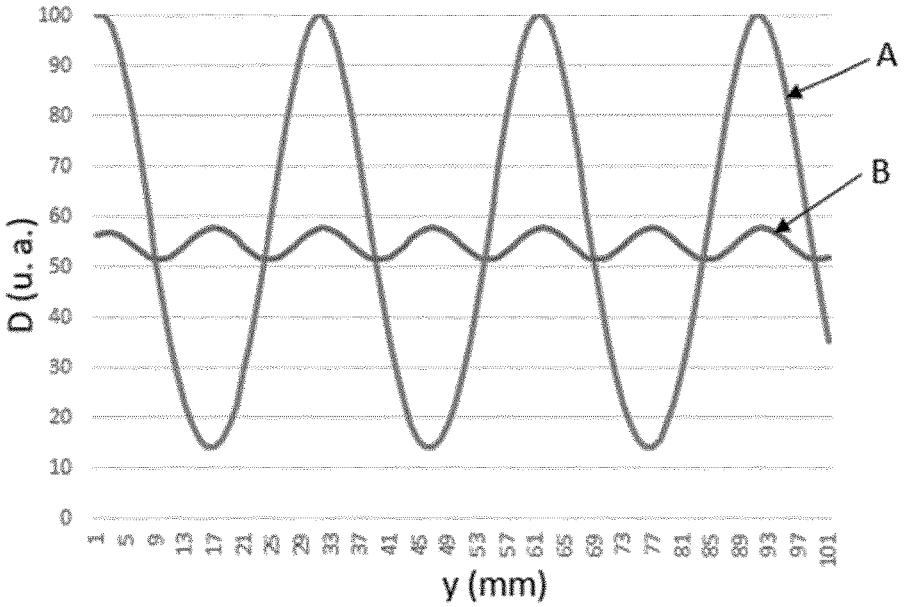
FIG. 6 shows the results of simulations of the flow of fluid output from mixing devices configured according to the prior art and from mixing devices according to the invention.

In order to illustrate the overall homogenization effect obtained with the invention, FIG. 6 shows the results of simulations of the propagation of a two-phase mixture in an exchanger comprising a conventional arrangement of passages with the same type of mixing devices (configuration A), and an arrangement of passages with first and second mixing devices configured according to the invention (configuration B).

In configuration A, each passage of the first set comprised a mixing device in the form of a grooved bar comprising, as longitudinal channels, a series of parallelepiped grooves succeeding each other at regular intervals of 30 mm and, as lateral channels, a series of parallelepiped grooves fluidly connected to the longitudinal channels by a single opening per longitudinal channel. The geometry of the openings was identical for all the longitudinal channels. The longitudinal channels of each mixing device were arranged in the same number and at identical positions $y_i$, $y_{i+1}$ in the lateral direction y.

In configuration B, first and second mixing devices were alternately arranged in the passages of the first set of passages of the exchanger. The first and second mixing devices were in the form of grooved bars identical to those of configuration A, in particular with grooves positioned at distances $D_A=D_B=30$ mm from each other, except that the series of grooves forming the longitudinal channels of the second mixing device were offset by a distance $D_y=D_A/2$ relative to the series of grooves forming the longitudinal channels of the first mixing device.

In configurations A and B, "serrated" type corrugations 11, i.e. partially offset, were arranged at the outlet of the mixing devices in each passage. These corrugations were of the "⅛" serrated" type (1'=1 inch=25.4 mm), i.e. with a serration length of 25.4/8=3.18 mm and had corrugations with a density of 24 fins per inch (1 inch=25.4 millimeters), measured in the lateral direction y. A hypothesis of the simulation is that the mixing rate was divided into two equal shares for each change in serration of the corrugations.

FIG. 6 shows the dimensionless mass flow rates obtained in the lateral direction y at a propagation distance of 200 mm, in the longitudinal direction z, after exiting the longitudinal channels and by averaging the flow rates over all the passages of the first set of the exchanger. It can be seen that the amplitude of the variation in the flow rate in the width of the exchanger is reduced in configuration B according to the invention.

Figure 7:
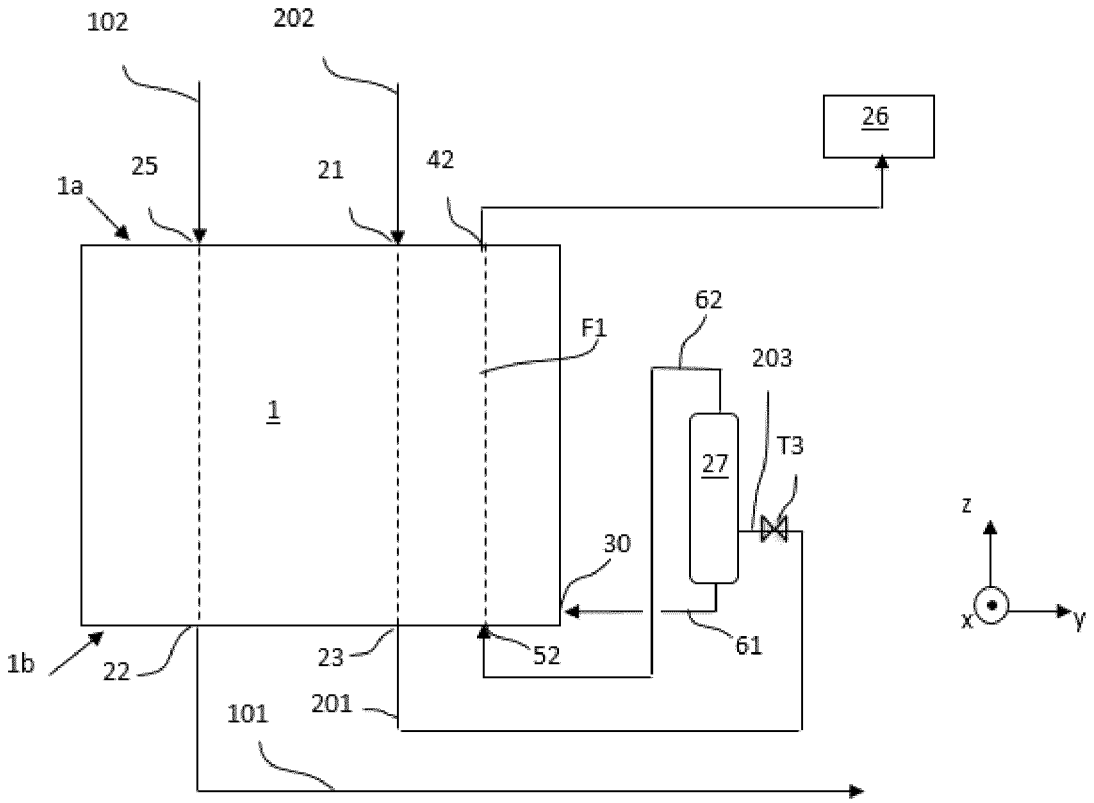
FIG. 7 schematically shows a method for liquefying a hydrocarbon stream according to one embodiment of the invention.
Figure 8:
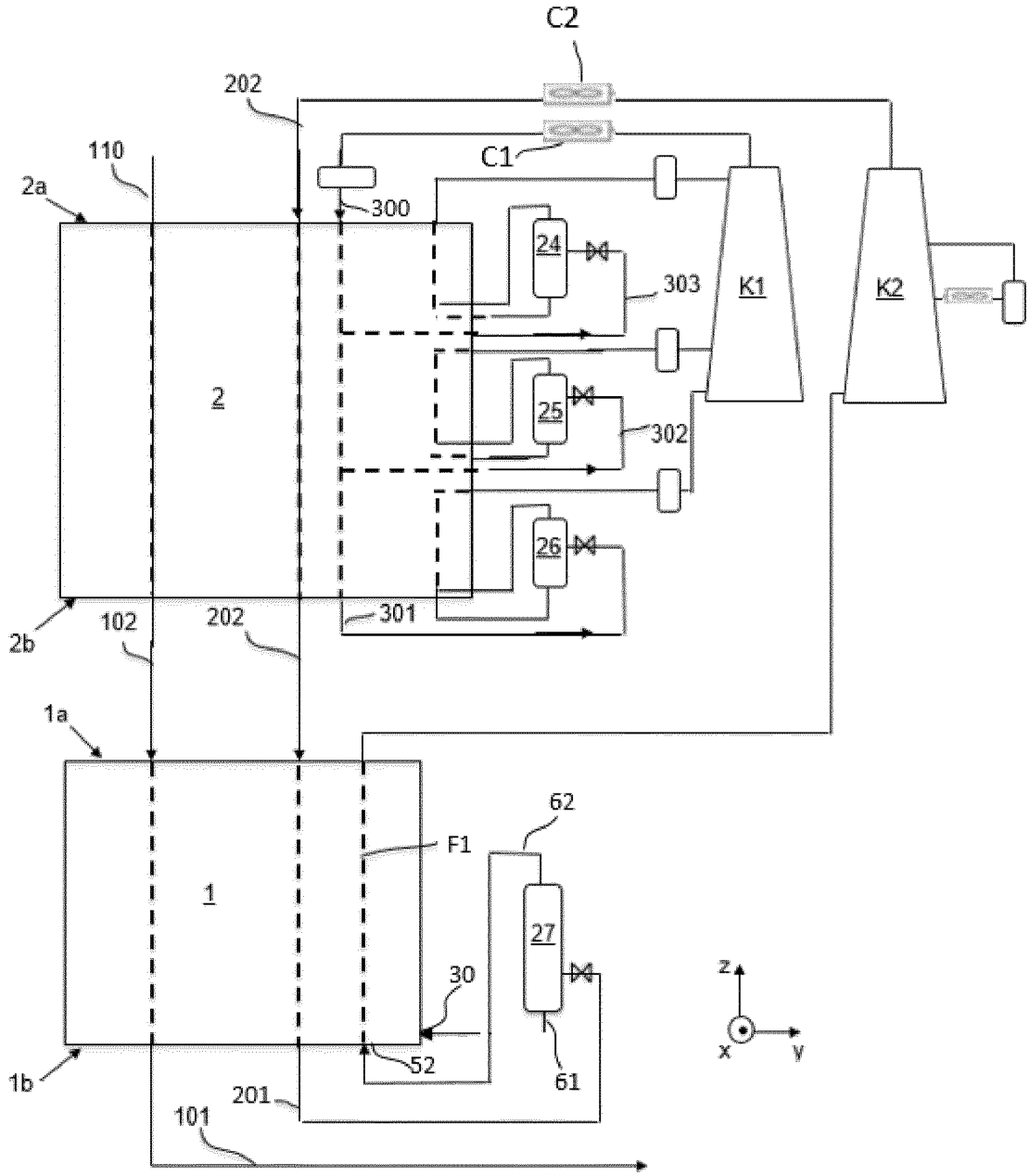
FIG. 8 schematically shows a method for liquefying a hydrocarbon stream according to another embodiment of the invention.

FIG. 7 and FIG. 8 show examples of methods implementing one or more exchanger(s) according to the invention.

FIG. 7 schematically shows a method for liquefying a hydrocarbon stream 102 as a second fluid F2, which can be natural gas, optionally pre-treated, for example, having undergone the separation of at least one of the following constituent elements: water, carbon dioxide, sulfur compounds, methanol, mercury, before being introduced into the heat exchanger 1.

Preferably, the hydrocarbon stream comprises, as a mole fraction, at least 60% methane, preferably at least 80%.

The hydrocarbon stream 102 and the cooling stream 202 enter the exchanger 1, respectively via a third inlet 25 and a fourth inlet 21, in order to circulate therein in dedicated passages of the exchanger in directions parallel to the longitudinal direction z, which is substantially vertical during operation. The hydrocarbon stream 102 circulates through the passages 20 of the second set supplied by the third inlet 25. The cooling stream 202 circulates through a third set of passages arranged within the stack forming the exchanger 1. These streams exit via a third outlet 22 and a first outlet 23. The passages of the second and third sets are arranged, in whole or in part, alternately and/or adjacent to all or some of the passages 10A, 10B of the first set.

Advantageously, the fourth inlet 21 for the cooling stream 202 and the third inlet 25 for the hydrocarbon stream 102 are arranged such that the cooling stream 202, and optionally the hydrocarbon stream 102, flows co-currently downwardly, toward a second end 1*b* of the exchanger, which is located at a level lower than that of a first end 1*a* of said exchanger. Preferably, the first end 1*a* corresponds to the hot end of the exchanger 1, i.e. the entry point of the exchanger where a fluid is introduced at the highest temperature of the temperatures of the exchanger, this entry point can be the fourth inlet 21 or the third inlet 25, depending on the method.

The hydrocarbon stream 102 can be introduced into the exchanger 1 at a temperature ranging between −130 and 40° C.

According to one possibility, the hydrocarbon stream 102 is introduced into the exchanger in the fully gaseous or partially liquefied state at a temperature ranging between −80 and −35° C.

According to another possibility, the hydrocarbon stream 102 is introduced into the exchanger 1 in a fully liquefied state at a temperature ranging between −130 and −100° C.

The cooling stream 201 exiting the exchanger 1 is expanded by an expansion component T3, such as a turbine, a valve or a combination of a turbine and a valve, so as to form a diphasic cooling stream 203 comprising a liquid phase and a gaseous phase. The diphasic cooling stream 203 forms the first previously considered fluid F1. At least part of the diphasic cooling stream 203 originating from the expansion is introduced into a separator component 27. The separator component can be any device adapted to separate a diphasic fluid into a predominantly gaseous stream, on the one hand, and a predominantly liquid stream, on the other hand.

The gaseous phase 62 is introduced via the manifold 52, which supplies the second inlets 321A, 321B of the first and second mixing devices 3A, 3B arranged in the first and second passages 10A, 10B of the first set. The liquid phase 61 is introduced via the first manifold 30, which supplies the first inlets 311A, 3118 of the first and second mixing devices 3A, 3B (not shown in FIG. 7).

Preferably, the gaseous phase is introduced via an inlet located in the region of the second end 1*b* corresponding to the cold end of the exchanger 1, i.e. the inlet point in the exchanger where a fluid is introduced at the lowest temperature of the temperatures of the fluids in the exchanger.

The two phases 61, 62 of the diphasic stream 203 are recombined within the exchanger 1 and distributed in the liquid-gas mixture state in the first 10A and second 10B passages of the exchanger 1 respectively provided with first 3A and second 3B mixing devices 3 according to the invention.

Preferably, the diphasic cooling stream 203 is introduced into the heat exchanger at a first temperature T1 ranging between −120 and −160° C. and exits the heat exchanger 1 at a second temperature T2 higher than the first temperature T1 preferably with T2 ranging between −35 and −130° C.

According to another possibility, the diphasic cooling stream 203 is introduced into the heat exchanger 1 at a first temperature T1 ranging between −130 and −80° C. and exits the heat exchanger 1 at a second temperature T2 higher than the first temperature T1 preferably with T2 ranging between −10 and 50° C.

Said at least part of the diphasic cooling stream 203 upwardly flows through the passages 10A, 10B and is vaporized by counter-currently cooling the natural gas 102 and the cooling stream 202. A cooled and/or at least partially liquefied hydrocarbon stream 101 is thus obtained at the outlet of the exchanger 1.

The vaporized cooling stream exits the exchanger 1 via a second outlet 42 connected to the manifold 55 in order to be compressed by a compressor and then cooled in an indirect heat exchanger by exchanging heat with an external cooling fluid, for example, water or air (at 26 in FIG. 1). The pressure of the cooling stream at the outlet of the compressor can range between 2 MPa and 9 MPa. The temperature of the cooling stream at the outlet of the indirect heat exchanger can range between 10° C. and 45° C.

In the method described in FIG. 7, the cooling stream is not split into separate fractions, but, in order to optimize the approach in the exchanger 1, the cooling stream can also be separated into two or three fractions, with each fraction being expanded at a different pressure level, and then sent to various stages of the compressor.

Preferably, the cooling stream 202 contains hydrocarbons having at most 5 carbon atoms, preferably at most three, more preferably at most two.

Preferably, the cooling stream 202 is formed, for example, by a mixture of hydrocarbons and nitrogen, such as a mixture of methane, ethane and nitrogen, but can also contain propane, butane, isobutane, n-butane, pentane, isopentane, n-pentane and/or ethylene.

The mole fraction proportions (%) of the components of the cooling stream can be:

Nitrogen: 0% to 10%
Methane: 20% to 70%
Ethane: 30% to 70%
Ethylene: 20 to 70%
Propane: 0% to 20%
n-butane: 0% to 30%
Isopentane: 0% to 20%

Optionally, the cooling stream can comprise, as a replacement for ethane, ethylene and, as a replacement for all or some of the propane, compounds of the C4, C5 type.

Preferably, the natural gas exits the exchanger 1 at least partially liquefied 101 at a temperature that is preferably higher than at least 10° C. in relation to the bubble temperature of the liquefied natural gas produced at atmospheric pressure (the bubble temperature denotes the temperature at which the first vapor bubbles form in a liquid natural gas at a given pressure) and at a pressure that is identical to the inlet pressure of the natural gas, to the nearest pressure losses. For example, the natural gas exits the exchanger 1 at a temperature ranging between −100° C. and −162° C. and at a pressure ranging between 2 MPa and 7 MPa. Under these temperature and pressure conditions, and depending on its composition, the natural gas does not generally remain liquid after expansion to atmospheric pressure.

Advantageously, the method for liquefying a hydrocarbon stream according to the invention can implement one or more additional refrigeration cycle(s) performed upstream of the main refrigeration cycle described above, so as to pre-cool the hydrocarbon stream.

FIG. 8 schematically shows a method for liquefying a hydrocarbon stream such as natural gas comprising an additional refrigeration cycle, in which the natural gas is cooled to a temperature close to its dew point using at least two different expansion levels in order to increase the efficiency of the cycle. This additional refrigeration cycle is implemented by means of an additional cooling stream 300 in an additional heat exchanger 2, called pre-cooling exchanger, arranged upstream of the heat exchanger 1 in the direction of the flow of the hydrocarbon stream 110, which then forms the liquefaction exchanger.

In this embodiment, a supply stream 110 arrives, for example, at a pressure ranging between 2.5 MPa and 7 MPa and at a temperature ranging between 20° C. and 60° C. With the supply stream 110 comprising a mixture of hydrocarbons such as natural gas, the cooling stream 202 and an additional cooling stream 300 enter the additional exchanger 2 in order to circulate therein in parallel and co-current directions in the downward direction.

A cooled, or even at least partially liquefied, hydrocarbon stream 102, exits the pre-cooling exchanger 2. Preferably, the hydrocarbon stream 102 exits in the gaseous or partially liquefied state, for example, at a temperature ranging between −35° C. and −70° C. The cooling stream 202 can also exit the exchanger 2 completely condensed, for 1© example, at a temperature ranging between −35° C. and −70° C. The stream 102 is then introduced into the exchanger 1.

As can be seen in FIG. 8, the stream 203 is vaporized in the exchanger 1 and exits the exchanger in order to be compressed by the compressor K2 and then cooled in the indirect heat exchanger C2 by exchanging heat with an external cooling fluid, for example, water or air. The cooling stream originating from the exchanger C2 is then returned to the additional exchanger 2.

The additional cooling stream 300 can be formed by a mixture of hydrocarbons such as a mixture of ethane and propane, but can also contain methane, ethylene, propylene, butane and/or pentane. The mole fraction proportions (%) of the components of the first coolant mixture can be:

Ethane: 30% to 70%
Propane: 30% to 70%
Butane: 0% to 20%

In the additional exchanger 2, which is also of the brazed plate and fin type, at least two partial streams originating from the additional cooling stream 300 are drawn from the exchanger on at least two distinct outlet points and are then expanded at different pressure levels, giving rise to partial diphasic expanded streams each comprising a first phase and a second phase. At least part of these partial diphasic streams is introduced into respective separator components 24, 25, 26.

In the embodiment of FIG. 8, three fractions, also called partial flow rates or streams, 301, 302, 303 of the additional cooling stream 300 in the first phase are successively withdrawn.

The gaseous and liquid phases separated by each separator component are introduced via separate inlets of the additional heat exchanger 2 and are recombined within mixing devices (not shown), so as to form at least two coolant fluids introduced into dedicated coolant passages in the liquid-gas mixture state. Alternatively, only the liquid phase is injected into the exchanger 2 and the gas phase is directed toward the inlet of the compression stages of the compressor K1. These coolants are vaporized in the additional exchanger 2 by exchanging heat with the supply stream 110 and the cooling stream 200 and the additional cooling stream 300.

Advantageously, at least two types of mixing devices 2 are arranged in the additional exchanger, such as those that can be arranged within the exchanger 1 according to the invention. Thus, the additional exchanger comprises at least two coolant passages each comprising a mixing device, with these devices comprising one or more of the features previously described for the first and second mixing devices 3A, 3B.

The vaporized coolants in their respective coolant passages are sent to various stages of the compressor K1, compressed and then condensed in a condenser by exchanging heat with an external cooling fluid, for example, water or air. The stream originating from the condenser is returned to the additional exchanger 2. The pressure of the first cooling stream at the outlet of the compressor K1 can range between 2 MPa and 6 MPa. The temperature of the additional cooling stream at the outlet of the condenser C1 can range between 10° C. and 45° C.

Preferably, the coolants upwardly flow from one end 2*b* of the additional exchanger 2 to another end 2*a* in the longitudinal direction z. The end 2*b* corresponds to the cold end of the additional exchanger 2 where the coolant is introduced at the lowest temperature of the temperatures of the additional exchanger 2.

Of course, the invention is not limited to the particular examples described and illustrated in the present application. Other alternative embodiments or embodiments within the competence of a person skilled in the art also can be contemplated without departing from the scope of the invention. For example, other configurations for injecting and extracting fluids into/from the exchanger, other flow courses and directions for the fluids, other types of fluids, other forms of mixing devices, of lateral and longitudinal channels, etc. obviously can be contemplated, depending on the constraints imposed by the method to be implemented.

The invention claimed is:

1. A heat exchanger comprising a plurality of plates arranged parallel to each other and to a longitudinal direction, said plates being stacked in a spaced-apart manner so as to together define at least one first set of passages configured for a first fluid to generally flow in the longitudinal direction and at least one second set of passages configured for the flow of a second fluid to be brought into a heat exchange relationship with the first fluid, at least one first passage of the first set of passages comprising a first mixing device and at least one second passage of the first set of passages comprising a second mixing device, each of the first and second mixing devices comprising:

at least one lateral channel configured in order for a first phase of the first fluid to flow from at least one first inlet;

a series of longitudinal channels extending in the longitudinal direction and each configured in order for a second phase of the first fluid to flow from a second inlet to a second outlet, said longitudinal channels succeeding each other in a lateral direction orthogonal to the longitudinal direction; and at least one opening fluidly connecting the at least one lateral channel to at least one longitudinal channel such that the first and second mixing devices are configured to distribute a mixture of the first phase and the second phase via the second outlets of their respective longitudinal channels, wherein the longitudinal channels of the first mixing device are at least partly arranged at positions in the lateral direction that are different from the positions of the longitudinal channels of the second mixing device.

2. The exchanger as claimed in claim 1, wherein the second mixing device comprises two longitudinal edges extending parallel to the longitudinal direction, each longitudinal channel of the first mixing device being interposed, in the lateral direction between two successive longitudinal channels of the second mixing device or between a longitudinal channel and a longitudinal edge of the second mixing device.

3. The exchanger as claimed in claim 2, wherein a single longitudinal channel of the first mixing device interposed, in the lateral direction, between two successive longitudinal channels of the second mixing device or between a longitudinal channel and a longitudinal edge of the second mixing device.

4. The exchanger as claimed in claim 1, wherein the longitudinal channels of the first mixing device are separated from each other by a first constant distance and the longitudinal channels of the second mixing device are separated from each other by a second constant distance, wherein the first distance and the second distance are equal.

5. The exchanger as claimed in claim 4, wherein the series of longitudinal channels of the second mixing device is offset by an offset distance measured in the lateral direction, relative to the series of longitudinal channels of the first device, wherein the offset distance is between 25 and 75% of the first distance ($D_A$).

6. The exchanger as claimed in claim 4, wherein the first distance and/or the second distance ranges between 10 and 40 mm.

7. The exchanger as claimed in claim 1, wherein each of the first and second passages has a longitudinal axis of symmetry extending parallel to the longitudinal direction, with the longitudinal channels of each first and second mixing device being arranged symmetrically relative to the longitudinal axis of symmetry.

8. The exchanger as claimed in claim 1, wherein the positions in the lateral direction of the longitudinal channels of the second mixing device coincide, following a 180° rotation in the plane defined by the lateral direction and by the longitudinal direction, with the positions in the lateral direction of the longitudinal channels of the first device.

9. The exchanger as claimed in claim 1, further comprising a plurality of alternately arranged first passages and second passages, with at least one passage of the second set of passages being arranged between at least one first passage and at least one second passage following said at least one first passage.

10. The exchanger as claimed in claim 1, wherein the lateral channels and/or the longitudinal channels of the first mixing device and the second mixing device are straight.

11. The exchanger as claimed in claim 1, wherein the first and second mixing devices each comprise a series of lateral channels extending in the lateral direction and succeeding each other in the longitudinal direction.

12. A method for liquefying a stream comprising hydrocarbons as a second fluid, said method implementing at least one exchanger as claimed in claim 1, and comprising the following steps:

a) introducing the hydrocarbon stream into the passages of the second set;

b) introducing a cooling stream into a third set of passages of the heat exchanger;

c) discharging the cooling stream from the heat exchanger and expanding the cooling stream to at least one pressure level so as to produce at least one diphasic cooling stream as a first fluid;

d) separating at least part of the diphasic cooling stream originating from step c) into a gaseous phase and a liquid phase;

e) introducing at least part of the gaseous phase and at least part of the liquid phase into each of the first and second passages of the first set, respectively, via separate inlets of said first and second passages;

f) passing the phases introduced in step e) into first and second mixing devices so as to obtain the first fluid as a mixture of the first phase and the second phase at the outlet of each of the first and second mixing devices;

g) vaporizing at least part of the first fluid originating from step f) in the first and second passages by exchanging heat with at least the hydrocarbon stream so as to obtain a cooled and/or at least partially liquefied hydrocarbon stream at the outlet of the exchanger.

* * * * *